US006904894B2

(12) United States Patent
Serizawa et al.

(10) Patent No.: US 6,904,894 B2
(45) Date of Patent: Jun. 14, 2005

(54) PULSATION REDUCING SYSTEM FOR FUEL LINE

(75) Inventors: Yoshiyuki Serizawa, Mishima (JP); Hikari Tsuchiya, Gotenba (JP); Koichi Hayashi, Mishima (JP); Tetsuo Ogata, Shizuoka (JP)

(73) Assignee: Usui Kokusai Sangyo Kaisha Ltd., Shizuoka (JP)

( * ) Notice: Subject to any disclaimer, the term of this patent is extended or adjusted under 35 U.S.C. 154(b) by 0 days.

(21) Appl. No.: 10/685,535

(22) Filed: Oct. 16, 2003

(65) Prior Publication Data

US 2004/0139947 A1 Jul. 22, 2004

(30) Foreign Application Priority Data

Oct. 18, 2002 (JP) ..... 2002-303951

(51) Int. Cl.[7] ..... F02M 37/04
(52) U.S. Cl. ..... 123/467; 123/456
(58) Field of Search ..... 123/467, 447, 123/456, 468, 469; 138/28, 27, 26, 30

(56) References Cited

U.S. PATENT DOCUMENTS 4,526,151 A * 7/1985 Tateishi et al. ..... 123/468
4,660,524 A * 4/1987 Bertsch et al. ..... 123/468
5,297,523 A * 3/1994 Hafner et al. ..... 123/456
5,390,692 A * 2/1995 Jones et al. ..... 137/513.3
5,577,479 A * 11/1996 Popp ..... 123/458
5,592,968 A * 1/1997 Nakashima et al. .... 137/561 A
5,692,476 A * 12/1997 Egler et al. ..... 123/456
5,752,486 A * 5/1998 Nakashima et al. ..... 123/467
6,401,691 B1 * 6/2002 Kawano et al. ..... 123/456

FOREIGN PATENT DOCUMENTS

| | | |
|---|---|---|
| JP | 62-26561 | 2/1987 |
| JP | 2777884 | 5/1998 |
| JP | 2002-106438 | 4/2002 |

* cited by examiner

*Primary Examiner*—Carl S. Miller
(74) *Attorney, Agent, or Firm*—Wenderoth, Lind & Ponack, L.L.P.

(57) ABSTRACT

A pulsation reducing system for a fuel line of an internal combustion engine, especially for an automotive engine equipped with an electronic fuel injection system is provided. The system includes a fuel delivery rail, a fuel tank, and a longitudinal main fuel pipe. A first flexible tube is arranged between the fuel delivery rail and the main fuel pipe. A second flexible tube is arranged between the main fuel pipe and the fuel tank. A small-ID tubular portion is arranged within the first tube or near the connecting portion of the first tube. The inside diameter of the small-ID tubular portion is smaller than that of the main fuel pipe. The length of the small-ID tubular portion is set between 10 to 50 times the inside diameter of the small-ID tubular portion itself. Thus, standing waves and resultant pressure pulsations caused by the fuel delivery rail are reduced by the small-ID tubular portion.

11 Claims, 5 Drawing Sheets

PULSATION REDUCING SYSTEM FOR FUEL LINE

BACKGROUND OF THE INVENTION

This invention relates to a pulsation reducing system for a fuel line of an internal combustion engine, especially for an automotive engine equipped with an electronic fuel injection system. In the fuel injection system, a fuel rail delivers pressurized fuel supplied from a fuel tank toward intake passages or chambers via associated fuel injectors. The fuel rail is used to simplify installation of the fuel injectors and fuel supply passages on the engine.

In particular, this invention relates to a pulsation reducing system comprising a fuel delivery rail for supplying fuel to fuel injectors, a fuel tank, and a longitudinal main fuel pipe for connecting the fuel tank to the fuel delivery rail.

As shown in the attached FIG. 14, an automobile 11 having an electronic fuel injection type engine 10 is provided with a main fuel line 13 which transfers fuel from a fuel tank 12 to the engine 10. The main fuel line 13 is usually supported on a front panel or beneath a floor panel by several clips 14.

With respect to the fuel delivery rail 15 mounted on the engine 10, there are two types; one is a return type having a return pipe and another is a non-return (returnless) type. In the return type, fuel is delivered from a conduit having a fuel passage therein to fuel injectors via cylindrical sockets and then residual fuel goes back to a fuel tank via the return pipe.

Recently, for economical reasons, use of the non-return type is increasing and new problems are arising therefrom. That is, due to pressure pulsations and shock waves which are caused by reciprocal movements of a fuel pump (plunger pump) and injector spools, the fuel delivery rail and its parts are vibrated thereby emitting uncomfortable noise. Further, this vibration and noise are transmitted through the clips 14, front panel and floor panel, to the driver and assistant.

In order to reduce the vibration and noise, several anti-vibration rubber clips or elastomer clips are supplied. However, some vibration and noise still remain without being eliminated.

The frequency components of the remaining vibration (pulsation) are considered as standing waves (stationary waves) which arise in the fuel delivery rail and continuously repeat internal reflection thereby keeping up. Further, the power level of the standing waves are considered as depending upon the length and flexibility of the fuel delivery rail.

Japanese Utility Model unexamined publication No. 62-26561 entitled "Fuel injection device of an internal combustion engine" discloses a pulsation damping tube comprising an elastomer member of which volume expands and shrinks due to the fuel pressure pulsations. However, this type of damping tube cannot provide a sufficient effect to the standing waves emitted from the fuel delivery rail.

Japanese Patent unexamined publication No. 2002-106438 entitled "Pulsation absorbing system for fuel piping" discloses a pulsation absorbing container comprising a metallic, synthetic resin or elastomer member arranged in the piping so as to eliminate the emission of the noise. However, this type of absorbing container is very expensive.

Japanese Patent No. 2777884 entitled "Connector for connecting a small pipe" discloses a quick-joint connector which can be used for connecting a small metallic or plastic pipe having an outside diameter less than 20 mm.

SUMMARY OF THE INVENTION

It is an object of the present invention to provide a pulsation reducing system for a fuel line which system can reduce the pulsations due to the standing waves caused by the reciprocal fuel injections of the fuel delivery rail.

It is another object of the present invention to eliminate emission of uncomfortable noise transmitted from outside to the interior.

It is still another object of the present invention to provide a flexible-tube and a quick-joint connector which can be utilized for the pulsation reducing system.

The pulsation reducing system according to the present invention is applied to an electronic fuel injection type engine comprising a fuel delivery rail for supplying fuel to fuel injectors, a fuel tank, and a longitudinal main fuel pipe for connecting the fuel tank to the fuel delivery rail.

In this system, the fuel delivery rail and the main fuel pipe are interconnected by a first flexible tube. Further, the main fuel pipe and the fuel tank are interconnected by a second flexible tube. Within the first tube or near the connecting portion of the first tube, a small-ID (inner diameter) tubular portion is arranged. The inside diameter of the small-ID tubular portion is smaller than that of the main fuel pipe, and the length of the small-ID tubular portion is set between 10 to 50 times of the inside diameter of the small-ID tubular portion itself. Thus, standing waves and resultant pressure pulsations caused by the fuel delivery rail are reduced by the small-ID tubular portion.

Based upon the above construction of the invention, in a fuel line of a fuel injection type engine, in cooperation with the small-ID tubular portion and the flexible tube, it has been found that it becomes possible to eliminate transmission of standing waves, which are generated in the fuel delivery rail, to the fuel main pipe. In addition, it also becomes possible to minimize transmission of uncomfortable noise and vibration from the fuel line to the panel and body. This noise and vibration are caused by the pressure pulsations due to the reflecting waves of injections and lack of dampening performance of the fuel line.

In a theoretical principle, standing waves in the fuel delivery rail, especially high-frequency components are reflecting and confined into the small-ID tubular portion, whereby the flexible tube becomes a damping element, so that it can prevent the vibration from being transmitted to the main fuel pipe.

According to the experiments, it is sufficient that the length of the small-ID tubular portion is defined between 10 to 50 times the inside diameter of the small-ID tubular portion itself. If the length is less than 10 times the inside diameter, advantageous results are not obtained. On the other hand, even if the length is larger than 50 times the inside diameter, significant differences are not shown and difficulties of layout arise.

As a preferred embodiment, it has been found that the sectional flow area of the small-ID tubular portion is preferably defined between 5 to 40 percent of that of the main fuel pipe. If the sectional flow area is less than 5 percent of that of the main fuel pipe, fuel flow resistance becomes larger thereby causing a great pressure loss. On the other hand, if the sectional flow area is larger than 40 percent of that of the main fuel pipe, reflecting effects within the small-ID portion becomes poor, whereby high-frequency sound components of the fuel pressure pulsations are transmitted to the main fuel pipe.

The small-ID tubular portion can be formed in miscellaneous modifications as follows:

(A) The small-ID tubular portion is formed as a protrusion extending from the end of the fuel delivery rail.

(B) The small-ID tubular portion is formed into a pipe inserted within the first tube.

(C) The small-ID tubular portion is integrally formed within the first tube.

(D) The small-ID tubular portion is formed as a protrusion extending from the end of said main fuel pipe.

(E) The small-ID tubular portion is formed on the main fuel pipe.

(F) The small-ID tubular portion is formed as a protrusion extending inside of the fuel delivery rail.

(G) A quick-joint connector is connected to the first tube, and the small-ID tubular portion is formed within the quick-joint connector.

The present invention further provides a pulsation reducing flexible tube which is utilized for the pulsation reducing system of a fuel line. This flexible tube is provided with a first cavity at one end thereof for receiving an end of the main fuel pipe and a second cavity at the other end thereof for receiving an end of the fuel delivery rail. A small-ID tubular portion is arranged between the first and second cavities so as to communicate with them. The sectional flow area of the small-ID tubular portion is set between 5 to 40 percent of the main fuel pipe. The length of the small-ID tubular portion is set between 10 to 50 times the inside diameter of the small-ID tubular portion itself. Thus, standing waves and resultant pressure pulsations caused by the fuel delivery rail are reduced by the small-ID tubular portion.

The present invention still further provides a pulsation reducing quick-joint connector which is utilized for the pulsation reducing system of a fuel line. This quick-joint connector is provided with a rugged surface at one end thereof for receiving an end of an elastic tube and a cavity at the other end thereof for receiving an end of a metallic or plastic tube. A small-ID tubular portion is arranged at the center of the rugged surface. The sectional flow area of the small-ID tubular portion is set between 5 to 40 percent of the main fuel pipe. The length of the small-ID tubular portion is set between 10 to 50 times the inside diameter of the small-ID tubular portion itself. Thus, standing waves and resultant pressure pulsations caused by the fuel delivery rail are reduced by the small-ID tubular portion.

Since the present invention can be applied to the existing fuel piping system by a simple change of the connecting construction, it has advantages of easy manufacturing and low cost as compared with the provision of a metallic or plastic vibration reducing container as in the prior art.

In this invention, the size of the small-ID tubular portion or flexible tube (synthetic rubber or plastic) are preferably defined by experiments or calculations such that, especially during idling of the engine, the vibrations and pressure pulsations are minimized.

Since the present invention is directed essentially to the piping construction of the existing fuel line, it can be applied to existing automobiles.

Other features and advantages of the invention will become apparent from descriptions of the embodiments, when taken in conjunction with the drawings, in which, like reference numerals refer to like elements in the several views.

DESCRIPTION OF THE PREFERRED EMBODIMENT

Figure 1:
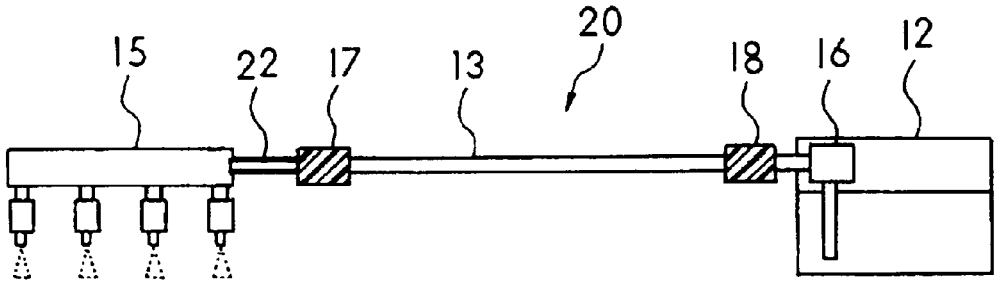
FIG. 1 illustrates a first type pulsation reducing system according to the invention.
Figure 2:
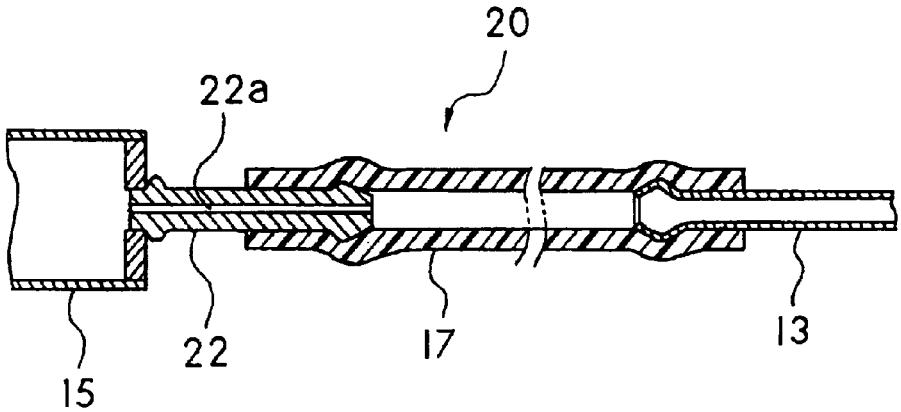
FIG. 2 is an enlarged partial sectional view of the system in FIG. 1.
Figure 14:
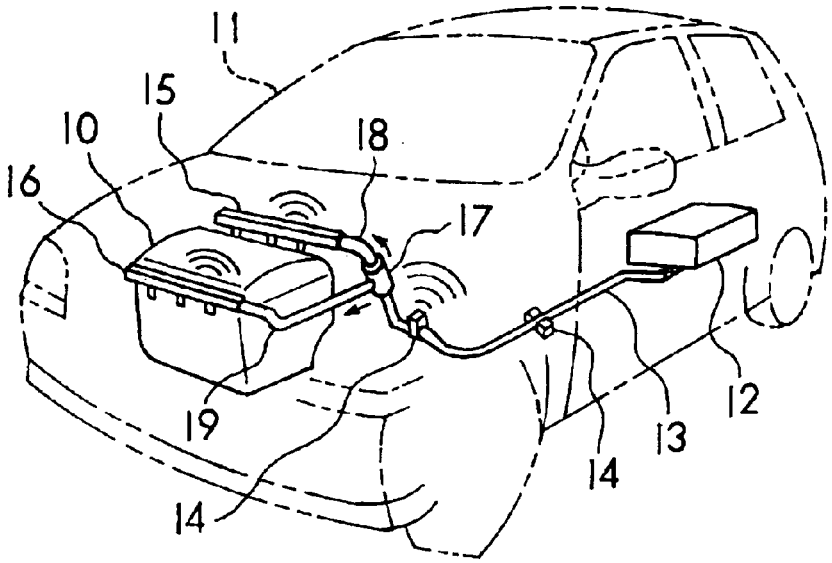
FIG. 14 is a perspective view of a fuel line from a fuel tank to an engine.

Referring to FIGS. 1 and 2, there is shown a first type embodiment of the present invention, a pulsation reducing system for a fuel line. This pulsation reducing system 20 is applied to an electronic fuel injection type engine 10 (FIG. 14). It comprises a fuel delivery rail 15 for supplying fuel to fuel injectors 19, a fuel tank 12, and a longitudinal main fuel pipe 13 for connecting the fuel tank 12 to the fuel delivery rail 15. This fuel line is a non-return (returnless) type having no fuel return pipe. The main fuel pipe 13 is supported on the front panel or beneath the floor body by several clips 14 as shown in FIG. 14.

In this system, the fuel delivery rail 15 and the main fuel pipe 13 are interconnected by a first flexible tube 17 such as a synthetic rubber or plastic. Further, the main fuel pipe 13 and the fuel tank 12 are interconnected by a second flexible tube 18. To the end of the fuel delivery rail 15 a protruded feed pipe (small-ID portion) 22 is fixed. One end of the first tube 17 is overlaid and secured to the feed pipe 22. At the center of the feed pipe 22 a small-ID passage 22*a* is formed.

The inside diameter of the passage 22*a* is considerably less than the inside diameter of the main fuel pipe 13. As an example, the length of the main fuel pipe 13 is 3,200 mm, and its inside diameter is 6.6 mm. The length of the small-ID passage 22*a* is 50 mm, and its inside diameter is 3.0 mm. Then, the length of the small-ID passage 22*a* is about 16.6 times of its inside diameter. The sectional flow area of the small-ID passage 22*a* is about 21 percent of the sectional flow area of the inside diameter of the main fuel pipe 13.

Standing waves and resultant pressure pulsations caused by the fuel delivery rail 15 are confined into the small-ID portion 22, so that the vibrations are isolated from the main fuel pipe 13. Thus, the pulsations of the main fuel pipe 13 are reduced. As shown in FIGS. 1 and 2, a portion of the feed pipe 22 is inserted into the flexible tube 17, so that the damping effects are enhanced by shock and vibration absorbing effect of the flexible tube 17.

Figure 3:
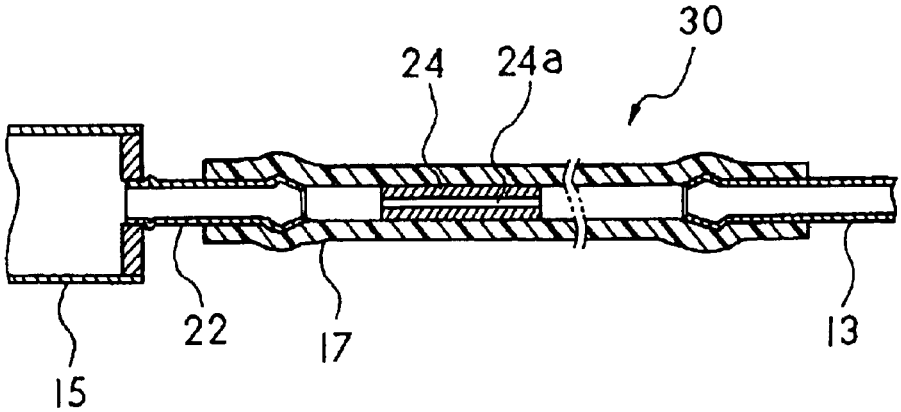
FIG. 3 is a partial sectional view of a second type pulsation reducing system.

FIG. 3 shows a second embodiment of the pulsation reducing system according to the invention. In this system 30, a sleeve 24 having a small-ID passage 24*a* therein is enclosed within the flexible tube 17. The inside diameter of the passage 24*a* is considerably less than the inside diameter of the main fuel pipe 13.

Figure 4:
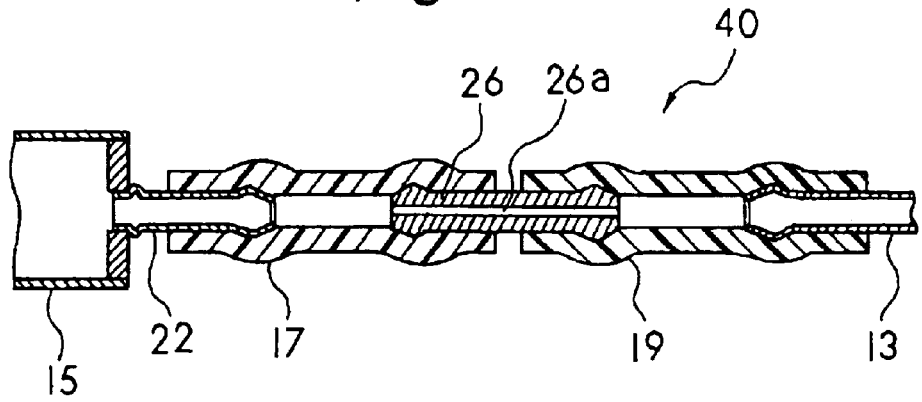
FIG. 4 is a partial sectional view of a third type pulsation reducing system.

FIG. 4 shows a third embodiment of the pulsation reducing system according to the invention. In this system 40, a sleeve 26 having a small-ID passage 26*a* therein is inserted within the flexible tubes 17 and 27. The sleeve 26 is interconnecting the tube 17 and the tube 27. The inside diameter of the passage 26*a* is considerably less than the inside diameter of the main fuel pipe 13. This embodiment has an advantage that it is easy to insert the sleeve 26 into the flexible tubes rather than the sleeve 24 in FIG. 3.

Figure 5:
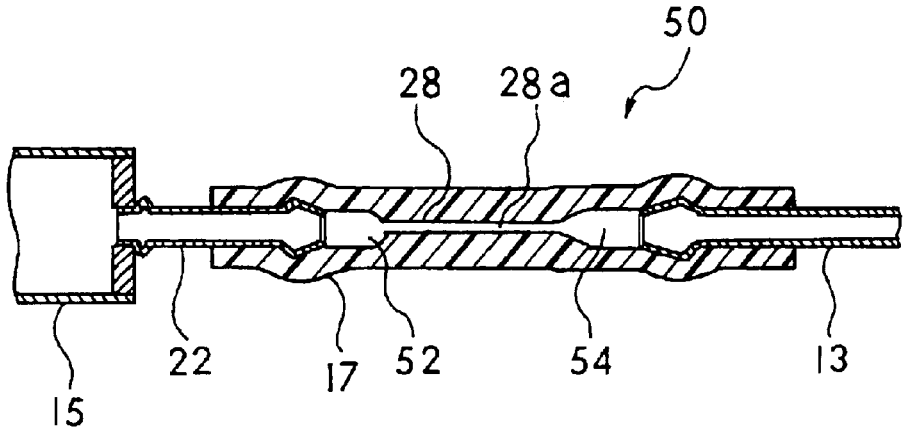
FIG. 5 is a partial sectional view of a fourth type pulsation reducing system.

FIG. 5 shows a fourth embodiment of the pulsation reducing system according to the invention. In this system 50, a small-ID portion 28 having a small-ID passage 28*a* therein is integrally formed within the flexible tube 17. The inside diameter of the passage 28*a* is considerably less than the inside diameter of the main fuel pipe 13.

FIG. 5 also shows another mode of the present invention. This flexible tube 17 is utilized for the pulsation reducing system of a fuel line. The flexible tube 17 is provided with a first cavity 54 at one end thereof for receiving an end of the main fuel pipe 13 and a second cavity 52 at the other end thereof for receiving an end of the fuel delivery rail 15. The small-ID tubular portion 28 is arranged between the first cavity 54 and the second cavity 52 so as to communicate with them. The sectional flow area of the small-ID tubular portion 28 is set between 5 to 40 percent of the flow area of the main fuel pipe 13. The length of the small-ID tubular portion 28 is set between 10 to 50 times the inside diameter of the small-ID tubular portion itself. Thus, standing waves and resultant pressure pulsations caused by the fuel delivery rail 15 are reduced by the small-ID tubular portion 28.

Figure 6:
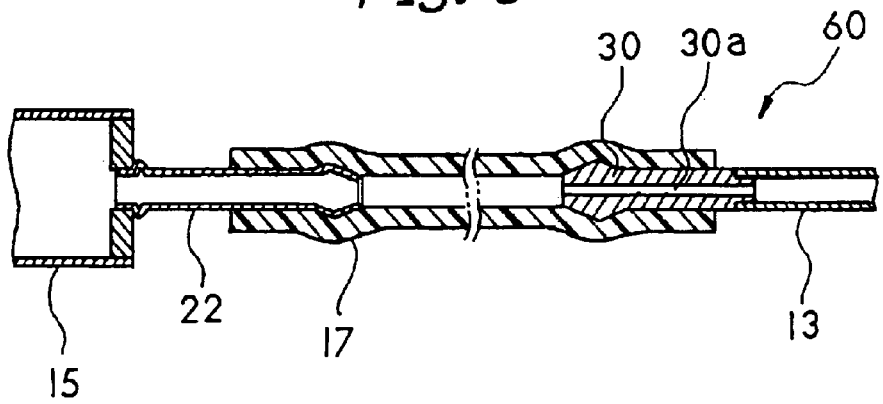
FIG. 6 is a partial sectional view of a fifth type pulsation reducing system.

FIG. 6 shows a fifth embodiment of the pulsation reducing system according to the invention. In this system 60, a small-ID portion 30 having a small-ID passage 30*a* therein is formed as a protrusion 30 extending from the end of the main fuel pipe 13. The inside diameter of the passage 30*a* is considerably less than the inside diameter of the main fuel pipe 13.

Figure 7:
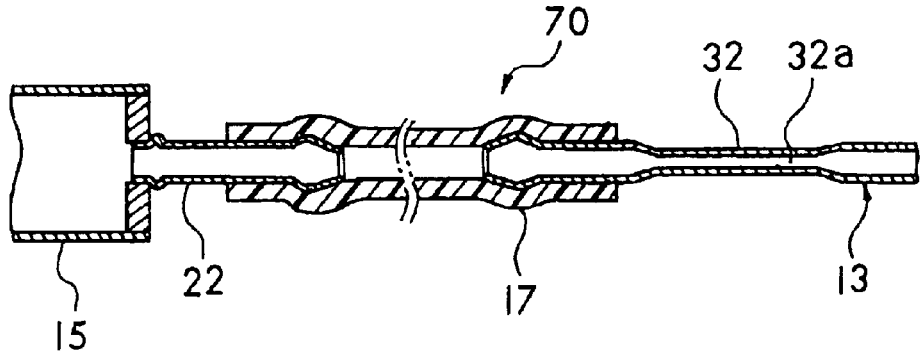
FIG. 7 is a partial sectional view of a sixth type pulsation reducing system.

FIG. 7 shows a sixth embodiment of the pulsation reducing system according to the invention. In this system 70, a small-ID portion 32 having a small-ID passage 32*a* therein is formed as a shrinkage 32 which is integrally formed at the end of the main fuel pipe 13. The small-ID portion 32 is located near the connecting portion between the flexible tube 17 and the main fuel pipe 13. The inside diameter of the passage 32*a* is considerably less than the inside diameter of the main fuel pipe 13. Since the small-ID portion 32 is located near the flexible tube 17, the damping effects are enhanced by shock and vibration absorbing effect of the flexible tube 17.

Figure 8:
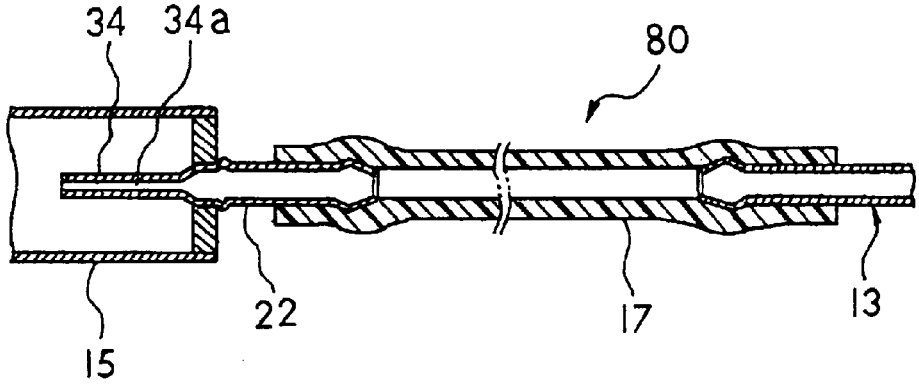
FIG. 8 is a partial sectional view of a seventh type pulsation reducing system.

FIG. 8 shows a seventh embodiment of the pulsation reducing system according to the invention. In this system 80, a small-ID portion 34 having a small-ID passage 34*a* therein is formed as an inside nozzle 34 of the fuel feed pipe 22 of the fuel delivery rail 15. The inside diameter of the passage 34*a* is considerably less than the inside diameter of the main fuel pipe 13. Since the outside end of the feed pipe 22 is inserted into the flexible tube 17, the damping effects are enhanced by shock and vibration absorbing effect of the flexible tube 17.

Figure 9:
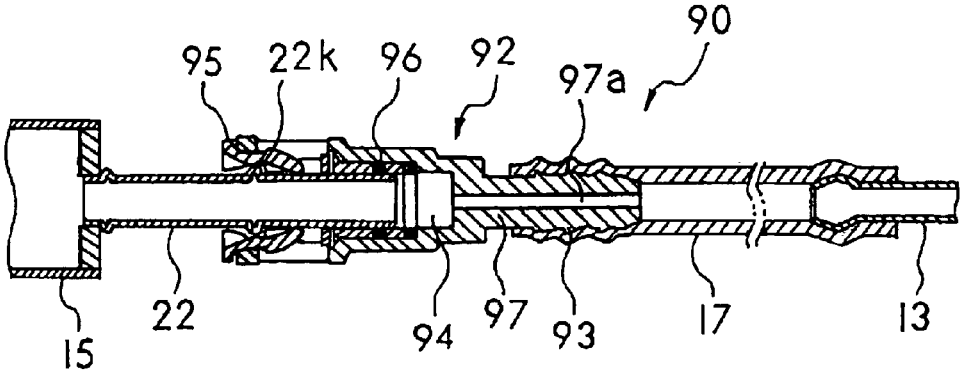
FIG. 9 is a partial sectional view of an eighth type pulsation reducing system.

FIG. 9 shows an eighth embodiment of the pulsation reducing system according to the invention. In this system 90, a quick-joint connector 92 is interconnecting the fuel delivery rail 15 and the flexible tube 17. A small-ID tubular portion 97 having a small-ID passage 97*a* therein is formed within the quick-joint connector 92. Since the connector 92 can be of a similar type such as that described in Japanese Patent No. 2777884, it is available in the connector market.

FIG. 9 also shows another mode of the present invention. This quick-joint connector 92 is adapted to the pulsation reducing system of a fuel line. The connector 92 is provided with a rugged surface 93 at one end thereof for receiving an end of an elastic tube 17 and a cavity 94 at the other end thereof for receiving an end of a metallic feed pipe 22. At the outside of the pipe 22, an annular ring 22*k* is formed for providing an engagement with the connector 92.

When an end of the feed pipe 22 is accommodated within the cavity 94, by means of a lock mechanism between a spring 95 and the annular ring 22*k*, the feed pipe 22 is secured in its position and sealing members 96 provide sealing effects.

The small-ID tubular portion 97 is arranged at the center of the rugged surface 93 for providing a fluid communication therethrough. The flow area of the small-ID tubular portion 97 is set between 5 to 40 percent of the main fuel pipe 13. The length of the small-ID tubular portion 97 is set between 10 to 50 times the inside diameter of the small-ID tubular portion 97 itself. Thus, standing waves and resultant pressure pulsations caused by the fuel delivery rail 15 are reduced by the small-ID tubular portion 97.

Figure 10:
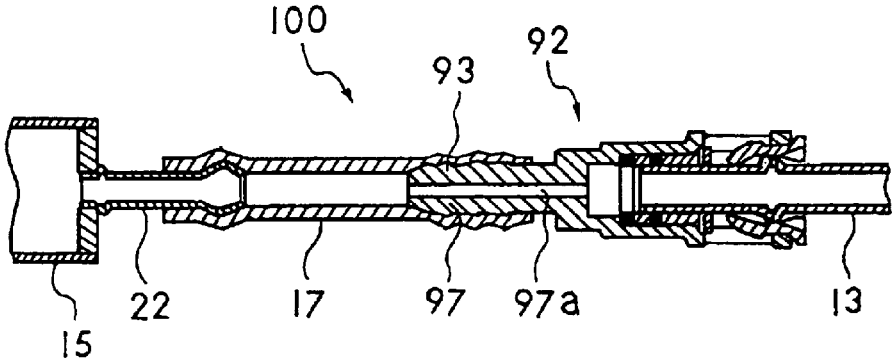
FIG. 10 is a partial sectional view of a ninth type pulsation reducing system.

FIG. 10 shows a ninth embodiment of the pulsation reducing system according to the invention. This system 100 is closely similar to the system 90 in FIG. 9. In FIG. 10, the quick-joint connector 92 is interconnecting the flexible tube 17 and the main fuel pipe 13. The direction of the connector 92 is opposite. A small-ID tubular portion 97 having a small-ID passage 97*a* therein is formed within the connector 92. The flow area of the small-ID tubular portion 97 is set between 5 to 40 percent of the main fuel pipe 13. The length of the small-ID tubular portion 97 is set between 10 to 50 times the inside diameter of the small-ID tubular portion 97 itself. Thus, standing waves and resultant pressure pulsations caused by the fuel delivery rail 15 are reduced by the small-ID tubular portion 97.

Figure 11:
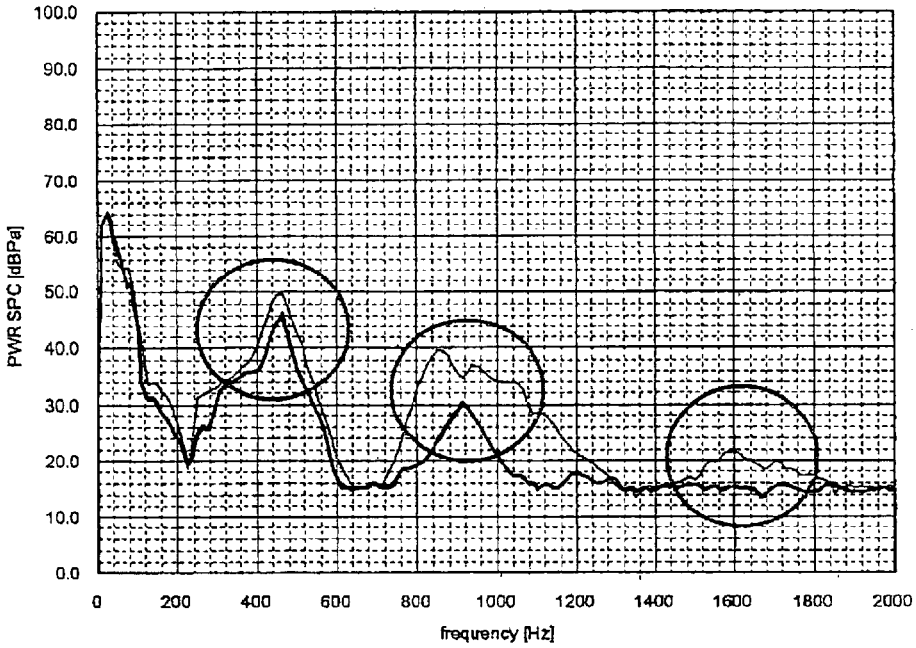
FIG. 11 is a graph showing the results of verification experiments.

FIG. 11 is a graph showing the results of verification experiments in which series four cylinders engine is used. A pressure sensor is inserted into the main fuel pipe. The relations between frequency components of the fuel pressure (Hz: horizontal axis) and power spectra (dBPa: vertical axis) are measured. Data of the prior art system are plotted in a slender line and data of the present invention are plotted in a bold line. As compared in these lines, near 450 Hz, 900 Hz, 1,600 Hz (which are emphasized by circles), it has been found that the vibration power level is reduced by the present invention.

Figure 12:
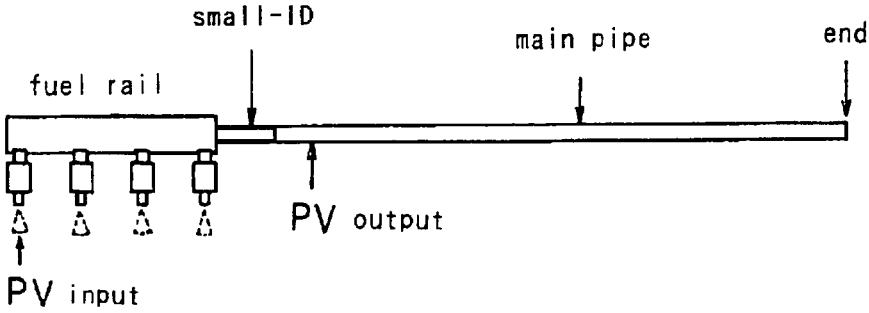
FIG. 12 illustrates a FEM model for analyzing the pulsation reducing system of the invention.

FIG. 12 illustrates a computerized FEM (Finite Element Method) model for analyzing the pulsation reducing system of the invention. One end of a small-ID tube having ID of 2 to 5 mm and length of 5 to 120 mm is connected to a fuel inlet end of a fuel delivery rail as an imaginary model by a computer. Another end of the small-ID tube is connected to a main fuel pipe. Pressure variations are entered from injectors into the fuel delivery rail as input data and output data (pressure variations) are calculated at the position of the open end of the main fuel pipe by the computer. From a view point of the most remarkable value, a pulsation frequency of 1.4 kHz is selected and analyzed.

Figure 13:
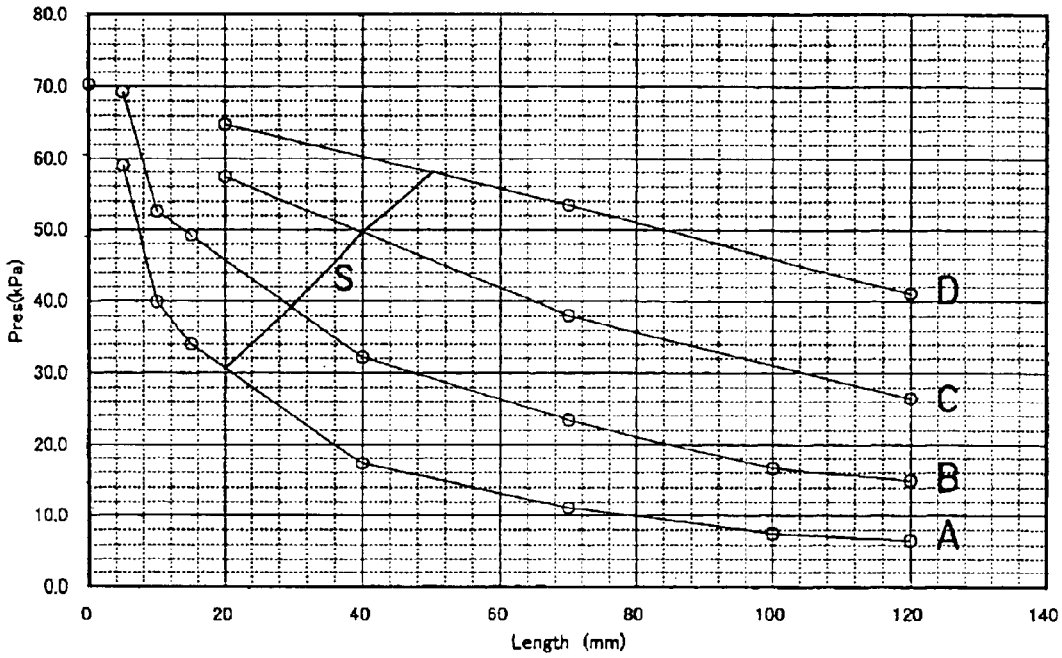
FIG. 13 is a graph showing the results of the FEM analyzing.

FIG. 13 is a graph showing the results of the FEM analyzing in which a pulsation frequency of 1.4 kHz is selected. The curved lines indicate the relations between the length (mm: horizontal axis) of the small-ID portion and pressure drop (kPa: vertical axis). The inside diameter of the main fuel pipe is 6.6 mm. The horizontal line 70 kPa corresponds to an initial pressure having no small-ID portion. The inside diameter of the small-ID portion is:

A: ID 2 mm (sectional area ratio 9 percent)

B: ID 3 mm (sectional area ratio 21 percent)

C: ID 4 mm (sectional area ratio 37 percent)

D: ID 5 mm (sectional area ratio 57 percent)

Each curved line A to D shows a descending tendency in which the output pressure goes down from 70 kPa in relation to the change of the length of the small-ID portion from 5 to 120 mm. The crossing line S indicates the position in which the length is 10 times of the inside diameter of the small-ID portion.

From this FEM analyzing, it has been confirmed that as far as the length of the small-ID tubular portion is more than 10 times the inside diameter of the small-ID portion, a good result is obtained. Further, from a point of view of application space, the length of the small-ID tubular portion is preferably less than 50 times the inside diameter.

It should be recognized that various modifications are possible within the scope of the invention claimed.

What is claimed is:

1. In a pulsation reducing system for a fuel line of an electronic fuel injection type engine comprising a fuel delivery rail for supplying fuel to fuel injectors, a fuel tank, and a longitudinal main fuel pipe for connecting the fuel tank to the fuel delivery rail, said pulsation reducing system comprising:

a first flexible tube is arranged between said fuel delivery rail and said main fuel pipe, a second flexible tube is arranged between said main fuel pipe and said fuel tank, and a small-ID tubular portion arranged within said first tube or near a connecting portion of said first tube, the inside diameter of said small-ID tubular portion is smaller than that of said main fuel pipe, the length of said small-ID tubular portion is set between 10 to 50 times the inside diameter of the small-ID tubular portion itself, whereby standing waves and resultant pressure pulsations caused by said fuel delivery rail are reduced by said small-ID tubular portion.

2. A pulsation reducing system as claimed in claim 1, wherein the sectional flow area of said small-ID tubular portion is set between 5 to 40 percent of the sectional flow area of said main fuel pipe.

3. A pulsation reducing system as claimed in claim 1, wherein said small-ID tubular portion is formed as a protrusion extending from an end of said fuel delivery rail.

4. A pulsation reducing system as claimed in claim 1, wherein said small-ID tubular portion is formed into a pipe inserted within said first tube.

5. A pulsation reducing system as claimed in claim 1, wherein said small-ID tubular portion is integrally formed within said first tube.

6. A pulsation reducing system as claimed in claim 1, wherein said small-ID tubular portion is formed as a protrusion extending from the end of said main fuel pipe.

7. A pulsation reducing system as claimed in claim 1, wherein said small-ID tubular portion is formed on said main fuel pipe.

8. A pulsation reducing system as claimed in claim 1, wherein said small-ID tubular portion is formed as a protrusion extending inside of said fuel delivery rail.

9. A pulsation reducing system as claimed in claim 1, wherein a quick-joint connector is connected to said first tube, and said small-ID tubular portion is formed within said quick-joint connector.

10. A pulsation reducing flexible tube for a fuel line of an electronic fuel injection type engine comprising a fuel delivery rail for supplying fuel to fuel injectors, a fuel tank, and a longitudinal main fuel pipe for connecting the fuel tank to the fuel delivery rail, characterized in that:

said flexible tube is provided with a first cavity at one end thereof for receiving an end of said main fuel pipe and a second cavity at the other end thereof for receiving an end of said fuel delivery rail, a small-ID tubular portion arranged between said first and second cavities so as to communicate with them, the sectional flow area of said small-ID tubular portion is set between 5 to 40 percent of the sectional flow area of said main fuel pipe; and the length of said small-ID tubular portion is set between 10 to 50 times the inside diameter of the small-ID tubular portion itself, whereby standing waves and resultant pressure pulsations caused by said fuel delivery rail are reduced by said small-ID tubular portion.

11. In a pulsation reducing quick-joint connector for a fuel line of an electronic fuel injection type engine comprising a fuel delivery rail for supplying fuel to fuel injectors, a fuel tank, and a longitudinal main fuel pipe for connecting the fuel tank to the fuel delivery rail, characterized in that:

said connector is provided with a rugged surface at one end thereof for receiving an end of an elastic tube and a cavity at the other end thereof for receiving an end of a metallic or plastic tube, a small-ID tubular portion is arranged at the center of the rugged surface, the sectional flow area of said small-ID tubular portion is set between 5 to 40 percent of the sectional area of said main fuel pipe; and the length of said small-ID tubular portion is set between 10 to 50 times the inside diameter of the small-ID tubular portion itself, whereby standing waves and resultant pressure pulsations caused by said fuel delivery rail are reduced by said small-ID tubular portion.

* * * * *